United States Patent [19]

Jenne

[11] Patent Number: 4,508,181

[45] Date of Patent: Apr. 2, 1985

[54] DRIVING HEAD FOR PNEUMATIC PILE DRIVERS

[76] Inventor: Gustav Jenne, Schmachtenberg Strasse 183, 4300 Essen-Kettwig, Fed. Rep. of Germany

[21] Appl. No.: 514,181

[22] Filed: Jul. 15, 1983

[30] Foreign Application Priority Data

Jul. 16, 1982 [DE] Fed. Rep. of Germany ..... 3226568

[51] Int. Cl.[3] ..... E21B 11/02

[52] U.S. Cl. ..... 175/19; 175/414

[58] Field of Search ..... 175/19–23, 175/389–391, 135, 414, 419, 420

[56] References Cited

U.S. PATENT DOCUMENTS

| | | | |
|---|---|---|---|
| 661,798 | 11/1900 | Glossop | 175/414 |
| 730,786 | 6/1903 | Murphy | 175/414 |
| 753,503 | 3/1904 | Martin | 175/414 |
| 3,926,267 | 12/1975 | Svirschevsky et al. | 175/19 |
| 4,144,941 | 3/1979 | Ritter | 175/19 |
| 4,193,461 | 3/1980 | Lamberton et al. | 175/19 |

FOREIGN PATENT DOCUMENTS

| | | | |
|---|---|---|---|
| 476356 | 11/1975 | U.S.S.R. | 175/19 |

*Primary Examiner*—Stephen J. Novosad
*Assistant Examiner*—Thuy M. Bui
*Attorney, Agent, or Firm*—Becker & Becker, Inc.

[57] ABSTRACT

A driving head which can be used for pneumatic pile drivers and can serve as an attachment head for rods or pipes which are to be driven in pile drivers. The driving head has an essentially circular front end and a conically expanding surface over the periphery of which are uniformly distributed a plurality of longitudinal grooves which start from the front end. Also provided is at least one transversely extending section which extends around the surface in a circle. The longitudinal grooves have a V-shaped cross section, and the surface of the driving head is formed by a plurality of conical sections which are offset in the manner of steps via jumps in the diameter. The end faces formed between the individual conical sections are disposed at an angle in a range of from 45° relative to 90° to the longitudinal center line of the driving head.

6 Claims, 4 Drawing Figures

Fig.3
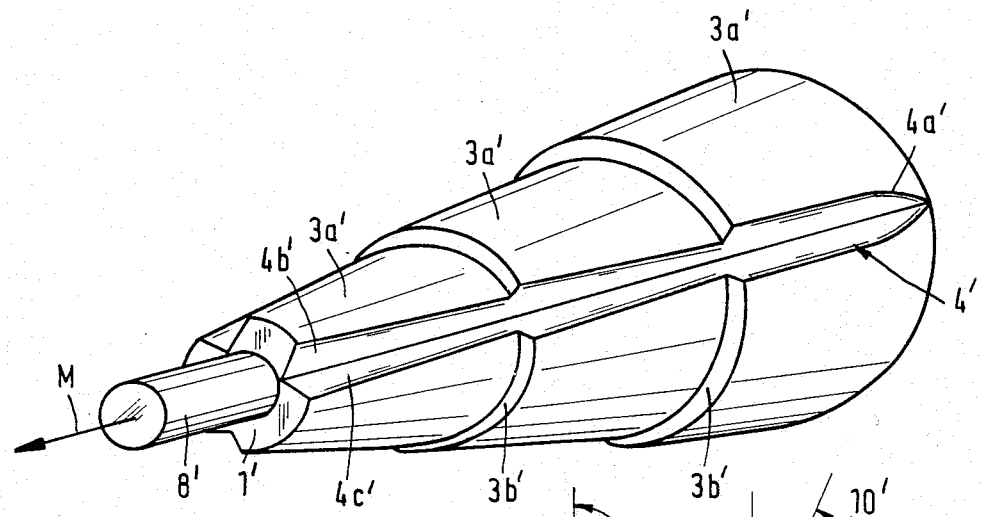
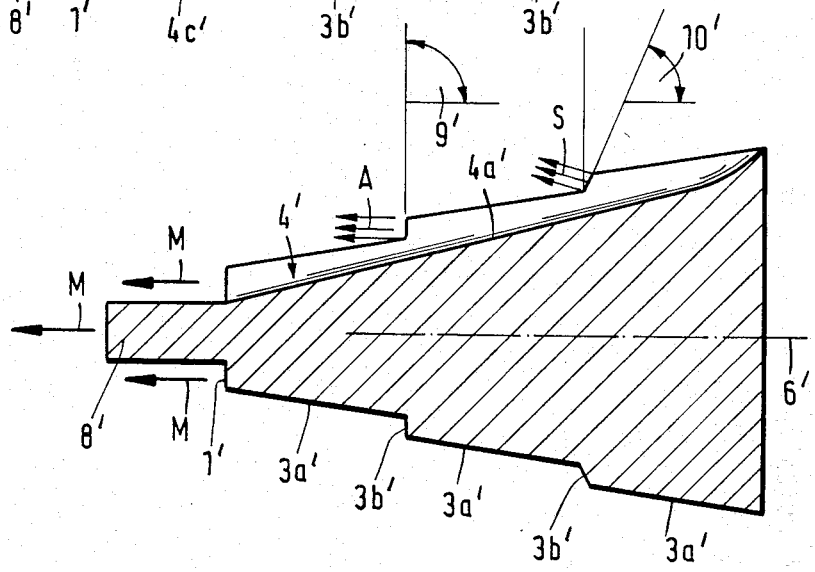
Fig.4

DRIVING HEAD FOR PNEUMATIC PILE DRIVERS

BACKGROUND OF THE INVENTION

The present invention relates to a driving head which can be used for pneumatic ramming apparatus or pile drivers and can also serve as an attachment head for rods or pipes which are to be driven or forced in by means of ramming apparatus or pile drivers. The driving head has an essentially circular front end, and a conically expanding surface over the periphery of which are uniformily distributed a plurality of longitudinal grooves which start from the front end. Also provided is at least one transversely extending section which extends around the surface of the driving head in a circular manner.

If articles are to be driven into the earth vertically, horizontally, or at an angle, the shape of the end of the article has a determinative effect upon the size and type of the resistance to penetration, which resistance is composed of an end resistance which acts on the front, and the surface friction which occurs on the lateral peripheral surfaces.

When a narrow conical head is driven into the ground, essentially only radial forces occur which are transmitted in proportion to the cone inclination. If, for example, the cone has an inclination of 1:10, the sum of the radial forces is ten times as great as the sum of the driven axial forces. A narrow cone therefore enters the earth very easily. However, since in order to obtain a state of equilibrium, the sum of all of the radial forces must be the same, a narrow cone is easily deflected sideways out of its intended direction when it encounters slight resistance.

However, the accuracy with which articles travel when entering the ground is often very significant, such as when driving in the rods or power drills, or steel pipes for obtaining ground water, and also when forcing pipes through or when using earth displacement hammers. To improve the accuracy of travel, the conical end of heretofore known devices was therefore replaced by a stepped head according to which the covering of the steps formed a conical shape which is embodied as a stepped surface yet is cylindrical. With such a driving head, the end faces of the steps conduct axial pushing and impact components into the ground. Under the effect of this axially directed force, with a slight radial tendency, the ground ahead of the end of the entering driving head is rearranged and homogenized. In so doing, loose areas receive more earth particles than do more densely packed areas, so that the radial resistance about the axis of the driving head is nearly uniform due to the rearrangement and homogenizing. The end faces of the steps can also apply fragmenting and rotary pulses in boulders, stones, or gravel, and can therefore positively affect the displacement process, especially when the driving head is not only pushed in statically, but is also dynamically driven in.

Despite the aforementioned advantages of a stepped head shape, the heretofore known devices have the drawback that a greater consumption of energy is required in order to press or drive the head into the ground. Furthermore, there exists the danger that the axial pushing and impact components will compress the ground ahead of the driving head in such a way that the entry of the head is brought to a halt. A particular problem occurs with fine sandy soil, the granular size of which is nearly uniform, i.e. with so called-single-grain soil which cannot be easily compacted and hence can also not be easily displaced.

It is an object of the present invention to provide a shape for a driving head of the aforementioned general type which, while providing as accurate a travel as possible, provides a reduction of the resistance to entry.

BRIEF DESCRIPTION OF THE DRAWINGS

This object, and other objects and advantages of the present invention, will appear more clearly from the following specification in conjunction with the accompanying drawings, in which:

FIG. 3 is an isometric view of a second embodiment of a driving head pursuant to the present invention, and has a stepped contour and a bit attachment; and FIG. 4 is a section through the driving head of FIG. 3.

SUMMARY OF THE INVENTION

Figure 1:
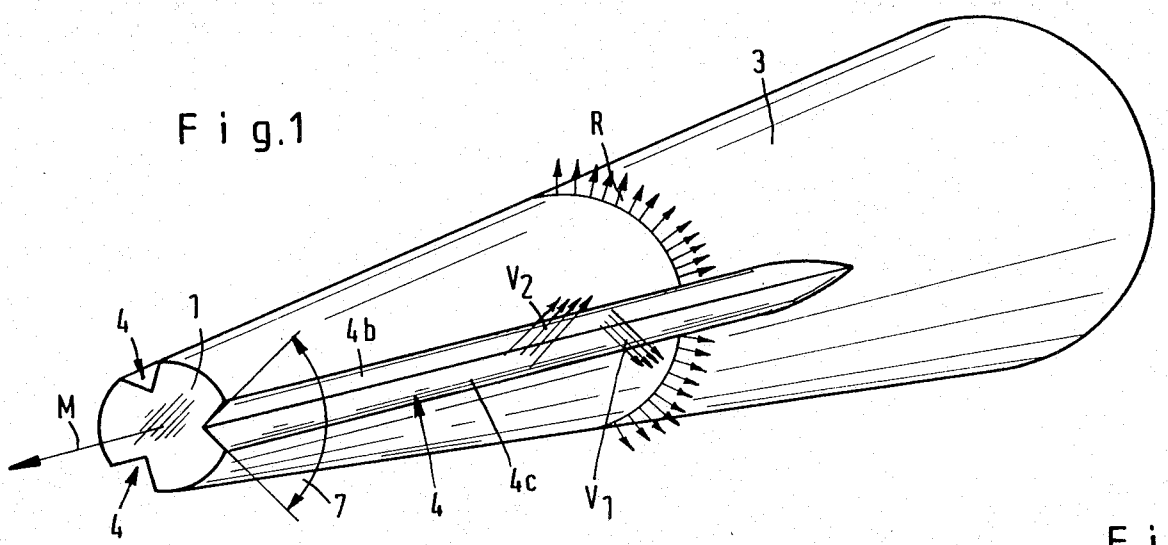
FIG. 1 is an isometric view of a first embodiment of the driving head of the present invention.

The driving head of the present invention is characterized primarily in that the longitudinal grooves have a V-shaped cross section, and the surface of the driving head forms a plurality of conical sections which are offset in the manner of steps by means of jumps in diameter; the end faces formed between the individual conical sections are disposed at an angle of from 45° to 90° to the longitudinal center line of the driving head.

Due to this inventive design of the driving head, which can be used either on pneumatic pile drivers, or as an attachment head for rods or pipes which are to be driven in, every grain of earth which is to be displaced is subjected to force pulses which are aimed in different directions, so that the earth is displaced in that direction which offers the least resistance to displacement. The inventive configuration furthermore gives rise on the front end of the driving head to a sort of star bit having as many cutting edges as there are longitudinal grooves. The earth located ahead of the front of the driving head is therefore split up upon entry of the head. The parts of the split up earth subsequently receive axial impact pulses, with some parts sliding into the longitudinal grooves. As a result, the earth is already plowed up at the front end of the driving head. The earth granules which slide into the longitudinal grooves are subsequently subjected to three force components, namely a radial component brought about by the cone inclination, and two displacement forces, each of which extends at right angles to one of the two side faces of the longitudinal grooves.

The inventive driving head thus not only provides cutting edges on its front end for splitting and pulverizing the earth which is to be entered, but also, in addition to surfaces which generate radial displacement components, provides cutting edges which are disposed on the surface and result from the line of contact between the longitudinal grooves and the conical surface. The radial displacement components, which result from the conical surfaces, are supplemented by displacement components which extend at right angles to the side faces of the longitudinal grooves. The inventively designed driving head kneads, pushes, displaces, plows through, splits, and chisels the ground in an optimum manner and hereby achieves a high travel accuracy at a simultaneously high speed. Since the longitudinal grooves can be easily produced with a V-shaped cross section, it is furthermore possible to manufacture the inventive driving head in an economical manner not only by casting but also by mechanical machining. Providing end faces between the individual conical sections results in stabilization edges which have a positive effect on the displacement action and travel stability of the inventive driving head.

In one preferred embodiment of the present invention, the side faces of the longitudinal grooves are disposed at an angle of 90° to one another. Pursuant to a further advantageous specific embodiment of the present invention, the conical sections of the surface of the driving head may form an average cone inclination of less than 15°.

Pursuant to further features of the present invention, the longitudinal grooves in the individual conical sections can either extend at an acute angle to the longitudinal center line of the driving head, which angle corresponds to the cone inclination of the respective conical section, or they can extend continuously over the entire length of the stepped driving head at an acute angle to the longitudinal center line, which angle corresponds to an average value of the cone inclination.

It is finally proposed pursuant to the present invention to arrange a cylindrical bit extension or attachment on the circular front end of the driving head. This bit attachment increases the breaking open and splitting force of the driving head since the full pushing or ramming energy is effective on the end face of the cylindrical bit attachment when the driving head encounters an obstacle. Thus, the provision of such a cylindrical bit attachment is especially suitable for rocky soil.

DESCRIPTION OF PREFERRED EMBODIMENTS

Figure 2:
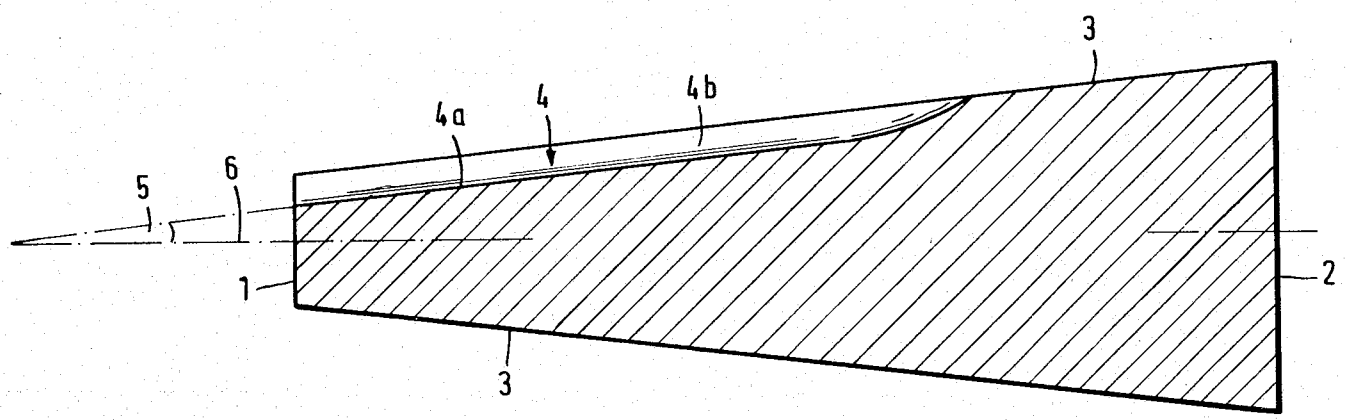
FIG. 2 is a cross section through the driving head of FIG. 1.

Referring now to the drawings in detail, the embodiment illustrated in FIGS. 1 and 2 shows a driving head which basically has a conical shape and a cone inclination which is less than 15°. The driving head has an essentially circular front end 1, the surface area of which is considerably less than the surface area of the back end 2. At this back end, the driving head is either disposed in a suitable manner on the front end of a pneumatic ramming apparatus or pile driver, or the back end of the driving head is arranged as a sort of attachment head on a rod or pipe which is to be forced or driven in.

In the embodiment illustrated in FIGS. 1 and 2, the surface 3 of the driving head which extends between the front end 1 and the back end 2 is embodied as a continuous cone. However, three longitudinal grooves 4 having V-shaped cross sections are uniformly distributed over the periphery of the surface 3. These longitudinal grooves 4 start from the circular front end 1 and, in the illustrated embodiment, extend approximately over three fourths of the length of the conical surface 3. As can be seen especially in FIG. 2, the ridge or separating line **4*a* of the longitudinal groove 4 extends at an acute angle 5 to the longitudinal center line 6 of the driving head. In the illustrated embodiment, the side faces 4*b* and 4*c* of the longitudinal groove 4 extend at an angle 7** of 90° to one another.

Due to the previously described configuration of the driving head, there results at the front end 1 a sort of star bit having a number of cutting edges in conformity with the number of longitudinal grooves 4. When the driving head enters the ground, these cutting edges of the bit effect splitting of the ground which lies ahead of it. A portion of the split earth receives axial impact pulses; other portions slide within the longitudinal grooves 4. This brings about a direct plowing up of the ground by means of the circular front end 1. The bit or cutting force applied by the front end 1 is designated in FIG. 1 by the arrow M.

As the driving head enters the ground, there is exerted thereupon a force composed of three force components. One of these force components is the radial force R, which is exerted from the conical surface 3. This radial force R is illustrated in FIG. 1 by means of a plurality of arrows. The two other force components are displacement forces $V_1$ and $V_2$, which are exerted from the side faces **4*b* and 4*c* of the longitudinal grooves 4** and are at right angles to these side faces. These displacement forces $V_1$ and $V_2$ effect a displacement of the surrouding earth, which displacement becomes effective in the circumferential direction of the driving head, so that the earth is displaced in that direction in which it meets with the least resistance to displacement. The driving head thus glides easily into the ground while maintaining a high directional stability.

In the second embodiment illustrated in FIGS. 3 and 4, a cylindrical bit extension or attachment 8' is arranged on the front end 1'. The bit attachment 8' increases the bit or cutting force M since the entire pushing or driving energy becomes effective on the attachment 8' when the driving head encounters an obstacle. Bit or cutting forces M are also exerted by the remaining portions of the front end 1', as shown by arrows in FIG. 4.

In this second embodiment, the surface of the driving head is formed by several conical sections **3*a*', which are offset in the manner of steps by means of jumps in diameter. Each of the conical sections 3*a*' extend at the same acute angle to the longitudinal center line 6' of the driving head. End faces 3*b*' are formed between the individual conical sections 3*a*'. If these end faces 3*b*' extend at an angle 9' of 90° to the longitudinal center line 6' of the driving head, the result is the creation of additional axial forces A, which are shown by arrows in FIG. 4. If, however, the end faces 3*b*' extend at an acute angle 10' to the longitudinal center line 6' of the driving head (also shown in FIG. 4**), inclined forces S result which, in addition to an axial component, also comprise a radial component and hence exert a displacing action on the ground.

As shown in FIGS. 3 and 4, the ridge or separating line **4*a*' of the longitudinal grooves 4' can extend continuously over the entire length of the stepped driving head at an acute angle to the longitudinal center line 6', with this acute angle conforming to an average value. Alternatively, it is also possible to have the longitudinal grooves 4' in the individual conical sections 3*a*' extend at an acute angle to the longitudinal center line 6' in such a way that the angle in each of the conical sections 3*a*'** corresponds to the cone inclination of that section.

Also in the second embodiment, with the longitudinal grooves 4' extending over the entire length of the driving head, the earth ahead of the driving head is split or fragmented by the bit or cutting force M, with not only the end face of the cylindrical bit attachment 8' but also the front end section 1' of the driving head proper taking part in this splitting and fragmenting work. The surfaces of the conical sections **3*a*' again exert an essentially radial displacement action on the ground when the driving head enters the latter. In so doing, pursuant to force pulses aimed in different directions, a portion of the earth which is to be displaced is broken up by means of the displacement forces $V_1$ and $V_2$ which are again exerted from the side faces 4***b*′ and 4*c*′ of the longitudinal grooves 4′ and insure that the earth is essentially displaced in that direction in which it meets the least resistance to displacement. Due to the end faces 3*b*′ formed on the actual surface of the driving head as a result of the stepped configuration, additional axial forces A or inclined forces S result, which on the one hand increase the directional stability of the driving head, and on the other hand also transmit to the ground those forces which exist in the actual surface of the driving head in the axial direction.

Both embodiments of the driving head described above thus result in a large part of the earth grain which is to be displaced being broken up pursuant to force pulses which are aimed in different directions, so that it is displaced in the direction of the least resistance to displacement, and so that, in addition to a high directional stability, a rapid and energy-saving introduction of the driving head into the ground is achieved.

The present invention is, of course, in no way restricted to the specific disclosure of the specification and drawings, but also encompasses any modifications within the scope of the appended claims.

What I claim is:

1. A driving head which can be used for pneumatic pile drivers, and which can serve as an attachment head for rods and pipes which are to be driven in by a pile driver; said driving head comprising an essentially circular front end, and a surface which essentially expands conically from said front end and which is provided with a plurality of longitudinal grooves that start from said front end, that have a V-shaped opening cross section, and that are uniformly distributed over the periphery of said surface; said surface of said driving head being formed of a plurality of conical sections which are offset from one another in the manner of steps as a consequence of jumps in the diameter of said surface, with end faces being formed thereby between respective conical sections, said end faces extending in a circular manner around said surface, being interrupted only by said longitudinal grooves; said end faces furthermore being disposed at an angle in a range of from 45°–90° relative to the longitudinal center line of said driving head.

2. A driving head according to claim 1, in which each of said longitudinal, V-shaped grooves comprises two side faces which are disposed at an angle of 90° relative to one another.

3. A driving head according to claim 2, in which said conical sections which form said surface of said driving head have an average cone inclination of less than 15°.

4. A driving head according to claim 3, in which, within a given one of said conical sections, said longitudinal grooves extend at an acute angle to the longitudinal center line of said driving head, said acute angle corresponding to the cone inclination of said given conical section.

5. A driving head according to claim 3, in which said longitudinal grooves extend over the entire length of said surface of said driving head at a continuous acute angle to the longitudinal center line of said driving head, said acute angle corresponding to an average value of the cone inclinations of said conical sections.

6. A driving head according to claim 5, which includes a cylindrical bit attachment disposed on said circular front end of said driving head.

* * * * *